United States Patent [19]

Köbler

[11] 4,373,445

[45] Feb. 15, 1983

[54] DOCTOR BLADE CONSTRUCTION FOR PRINTING MACHINE

[75] Inventor: Ingo Köbler, Gessertshausen, Fed. Rep. of Germany

[73] Assignee: M.A.N.-ROLAND Druckmaschinen Aktiengesellschaft, Offenbach am Main, Fed. Rep. of Germany

[21] Appl. No.: 268,095

[22] Filed: May 27, 1981

[30] Foreign Application Priority Data

May 29, 1980 [DE] Fed. Rep. of Germany ..... 3020306

[51] Int. Cl.[3] ..... B41F 31/04

[52] U.S. Cl. ..... 101/365; 101/157; 101/169; 118/261

[58] Field of Search ..... 101/365, 167, 169, 157; 118/261

[56] References Cited

U.S. PATENT DOCUMENTS 2,283,830 1/1941 Taylor ..... 101/365

FOREIGN PATENT DOCUMENTS 2545737 4/1977 Fed. Rep. of Germany .

*Primary Examiner*—William Pieprz
*Assistant Examiner*—Bradley M. Lewis
*Attorney, Agent, or Firm*—Frishauf, Holtz, Goodman, Woodward

[57] ABSTRACT

To permit independent adjustability of the working zones of a doctor blade, without interference of adjustment of one zone (10/1) with respect to adjacent zones (10/2, 10/3), the doctor blade (3) is subdivided by grooves (9) located at the upper surface thereof and positioned in pairs, which extend from the working edge (8) towards the clamping zone (4) of the doctor blade and converging towards each other in V-shaped formation to include an acute angle therebetween and define a transition zone (15) therebetween, the region (14) of the doctor blade beneath the grooves forming fulcrum points permitting hinge-like deflection of adjacent portions or zones of the doctor blade with respect to each other, without mutual interference of adjustment. The deformability of the doctor blade results in exactly defined transfer of ink in each inking zone (11/1, 11/2, 11/3) from the duct roller (2) to the inking transfer rollers of the printing system, without mutual influencing of adjacent inking zones.

7 Claims, 4 Drawing Figures

DOCTOR BLADE CONSTRUCTION FOR PRINTING MACHINE

The present invention relates to a doctor blade for a printing machine and more particularly to a doctor blade in which various zones of ink transfer from a duct roller can be accurately controlled.

BACKGROUND

Elongated doctor blades which have flexibility transverse to their longitudinal direction are known in the art, see, for example, German Patent Disclosure Document DE-OS No. 25 45 737 and U.S. Pat. No. 2,283,830.

The doctor blade is subdivided into regions or zones by grooves formed therein which extend parallel to each other. The structure described in the German Disclosure Document DE-OS No. 25 45 737 has groove-like recesses with semicircular cross-section. The structure described in this U.S. Pat. No. 2,283,830 has grooves with a square, or, alternatively, triangular cross-section.

It has been found that neither of the solutions proposed in the above publications ensure that application of a certain zone of the doctor blade to the duct roller will result in specific independent adjustment without affecting adjacent zones; rather, positioning of a certain zone of the doctor blade with respect to the duct roller influences adjacent zones. Consequently, it is difficult to arrange the ink supply in clearly defined zones with definite widths without overlap, or drawing over the edge of the adjacent zone.

THE INVENTION

It is an object to provide a doctor blade which is so arranged and has such a geometry that adjustment of the ink transfer from a duct roller by the respective zones or partial regions or ranges of the doctor blade will provide for a definite ink quantity to be applied thereto, with uniform thickness, over the entire width of an inking zone without affecting the ink coating in an adjacent zone.

Briefly, in accordance with the invention, the doctor blade is formed with two groove-like recesses separating adjacent zones, the recesses starting from the edge of the doctor blade and extending towards the clamping region thereof and converging in essentially V-shape.

The structure permits utilization of the included portion of the doctor blade between the "V" of the groove to provide a hinging effect so that the doctor blade can be independently adjusted with respect to a duct roller in the region between the V-groove pairs.

DRAWINGS

Figure 1:
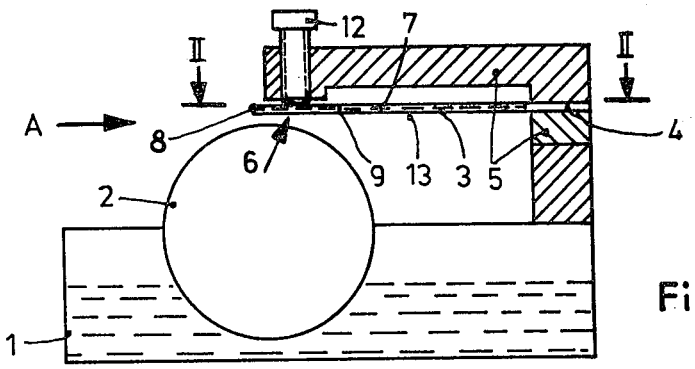
FIG. 1 is a schematic side view, partly in section, of a doctor blade positioned against a duct roller of a printing machine inking system.

An ink trough 1, see FIG. 1—has a duct roller 2 operating therein. The amount of ink being picked up is controlled by engagement of the duct roller with a doctor blade 3. The doctor blade has a clamping region 4 with which it is clamped in a multiple component holder 5, extending longitudinally along the ink trough, that is, axially with respect to the duct roller 2. The doctor blade has a projecting portion 6 which extends freely from the clamping region 4. The working region 6 is axially—with respect to the duct roller—or longitudinally, with respect to the doctor blade subdivided by grooves 9 which separate the doctor blade into continuous, but separately adjustable portions or zones 10. These grooves are formed on the back surface 7 of the doctor blade 3 and start from the forward edge 8 thereof. The zones permit adjustment of the thickness of the ink coating applied by the duct roller in one ink zone 11 by means of an adjustment element 12—as shown, an adjustment screw—which is rotatably retained in the clamping holder 5. A plurality of such adjustment screws are provided, at least one for each zone 10 for individual matching of the thickness of the ink film being transported by the duct roller 2 in the individual zone.

Figure 2:
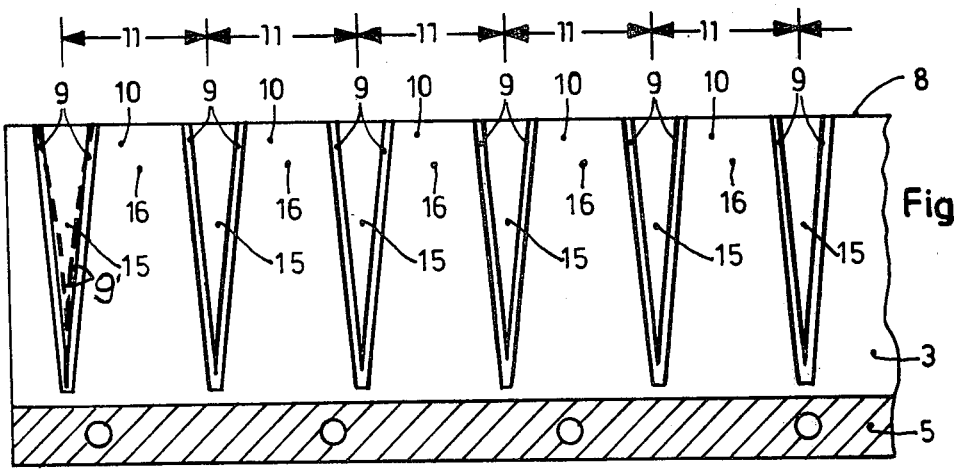
FIG. 2 is a cross-sectional view along line II—II of FIG. 1.

In accordance with the invention, adjacent zones 10 of the doctor blade 3 are separated by two groove-like recesses 9 which start from the front edge of the doctor blade and converge towards each other towards the clamping region thereof to form essential V-shape, see FIG. 2. The grooves may be straight, or may be bowed, as seen at 9', in which bowed center lines have been added for comparison with straight grooves. Bowed grooves 9' can be used as well as the straight grooves on any one doctor blade. The grooves converge toward each other, and, preferably, have rectangular cross-section and are so formed in the upper surface of the doctor blade 3 that a bending zone 14—see FIGS. 3 and 4—will result between the lower surface 13 and the root, or bottom of the groove 9. This bending zone 14 will have essentially rectangular cross-sections, leaving, between the adjacently facing sidewalls of the grooves 9 an essentially wedge-shaped doctor blade portion 15. The two, generally V-shaped converging grooves 9 are related to each other by an acute angle, and, preferably, start immediately in front of the clamping region 4, where they merge into each other. The depth of the grooves 9 is, preferably, about half the thickness of the doctor blade.

Figure 3:
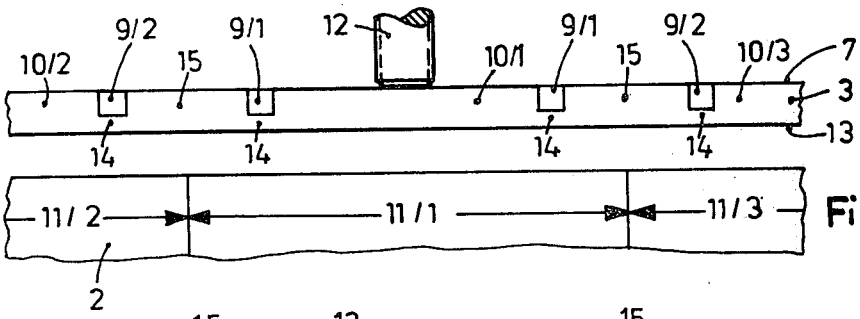
FIG. 3 is a highly enlarged fragmentary top view of the doctor blade in its position with respect to the duct roller, and looking in the direction of the arrow A of FIG. 1.
Figure 4:
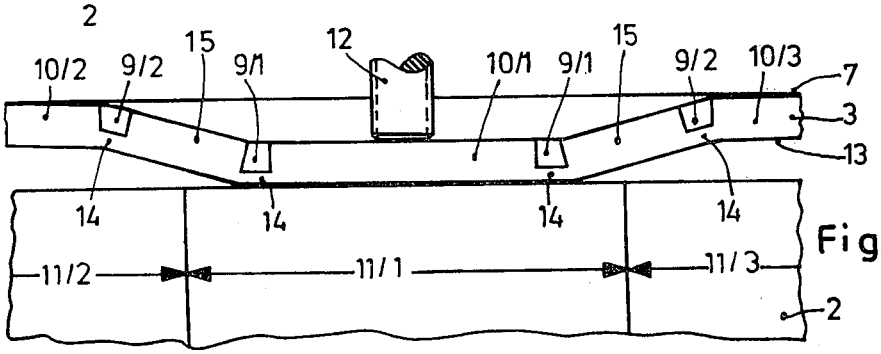
FIG. 4 illustrates the same portion of the doctor blade shown in FIG. 3 in which a section, or zone of the doctor blade has been deflected for lesser ink transfer from the duct roller than adjacent sections.

The width of any one inking zone 11 is determined by the distance of two center lines which pass between two adjacent pairs of the V-shaped grooves 9. The widths of the zones 11 will remain exactly the same both when the doctor blade is slightly spaced from the duct roller, to permit ink transfer, as well as when it is in engagement with the surface thereof to remove all, or a major portion of the ink being transferred thereby. FIGS. 3 and 4 illustrate this relationship by showing, in a greatly enlarged scale, the position of the doctor blade with respect to the duct roller 2 in one full and two adjacent partial zones 11.

FIGS. 3 and 4 illustrate the center zone 11/1, between the dimension arrows in its complete extent; the adjacent left and right zones 11/2, 11/3 are shown only partially. The lower edge 13 of the doctor blade 3 is spaced by the same distance over its entire width from the duct roller 2, so that all three ink zones 11/1, 11/2 and 11/3 will permit transfer of ink to a subsequent transfer roller of a film of uniform thickness. FIG. 4 illustrates a different position of the adjustment screw 12; in the arrangement as illustrated in FIG. 4, ink transport is permitted essentially only in the zones 11/2 and 11/3, since the zone 10/1 of the doctor blade in the ink zone 11/1 is completely in engagement with the duct roller 2 and, consequently, the ink surface coating is removed from the duct roller in the zone 11/1. Positioning of the zone 10/1 on the duct roller 2 is done by suitable adjustment of the screw 12 which, as seen in FIG. 2, preferably engages at the points 16, that is, close to the front edge 8 of the doctor blade and centrally within the zone 10 of the doctor blade. As seen in FIG. 4, the screw 12 is engaged centrally in zone 10/1 and presses this zone against the duct roller 2. Consequently, zone 10/1 will bend and, due to the geometry of the adjacent grooves 9/1 and 9/2 of the doctor blade portion 15 will not deflect from an essentially straight line—see FIG. 4. This is obtained since the bending zones 14 which are located in a portion only of the thickness of the doctor blade have a hinge effect, as illustrated by the two grooves 9/1, 9/2 in the range 14, adjacent the portion 10/1 of the doctor blade. As best seen in FIG. 4, upon engaging the zone 10/1 on the duct roller 2 the bending regions 4 will remain, forming fulcrum points to permit bending of the bending regions 14. The portions 14 between the converging grooves 9 will essentially retain a straight form and will act in the region of the front edge 8 of the doctor blade 3 approximately in the manner of a rigid beam clamped at two sides.

Deformation of the doctor blade 3, as shown, insures exactly defined application of ink in each zone without relative influence of the adjustment of an adjacent zone, thus substantially improving the quality of printing which results.

Various changes and modifications may be made within the scope of the inventive concept.

In one operating example, a doctor blade made of spring steel had a length of 1.02 m, for use with an ink duct roller 2 of 1.02 m length. The doctor blade had a thickness of 1.5 mm. The distance from edge 8, that is, the forward edge to the clamp 5 was 10 cm. The distance between adjacent screws 12 was 4 cm. The distance between grooves of V at edge 8 was 4 cm, resulting in a convergence angle of the grooves 9 of 6 yrd.

The grooves, in cross-section, were essentially square, that is, about 1 mm wide, when the doctor blade was in the flat position shown in FIG. 3.

I claim:

1. Elongated doctor blade for use in the inking system of a printing machine having a clamping zone (4) extending in the direction of elongation of the doctor blade and at an extremity along the length of the doctor blade;

a working zone, projecting transversely to the direction of elongation of the doctor blade and extending from the clamping zone (4) and terminating in a working edge at said other extremity of the doctor blade;

and grooves (9) formed on the surface of the doctor blade starting at the working edge, and extending towards the clamping zone and subdividing the blade into a plurality of individually positionable interconnecting zones, each of which can be individually adjusted with respect to an ink duct roller (2) of the printing machine wherein, in accordance with the invention, the plurality of grooves (9) are arranged in pairs, the two grooves of each pair separating the zones (10) from each other and extending, in addition to the direction from the working edge (8) towards said clamping zone, at an inclination towards each other to converge in V-formation and merging into each other at the apex of the V with the open part of the V formation located at the working edge and the apex thereof spaced from the working edge towards the clamping zone.

2. Doctor blade according to claim 1 wherein the grooves (9) have essentially rectangular cross-section, said grooves defining a bending region (14) between the bottom of the grooves and the opposite surface (13) of the doctor blade, of essentially rectangular cross-section;

said grooves further defining a wedge-shaped doctor blade portion (15) between adjacent sidewalls of the converging grooves (9) of a pair.

3. Doctor blade according to claims 1 or 2 wherein the grooves (9) are formed in the surface of the doctor blade remote from the axis of the ink duct roller to be positioned on the upper surface thereof, and extend in straight line direction from the working edge (8) towards the clamping zone.

4. Doctor blade according to claims 1 or 2 wherein the grooves (9) are formed in the surface of the doctor blade remote from the axis of the ink duct roller to be positioned on the upper surface thereof, and extend in curved direction from the working edge (8) towards the clamping zone.

5. Doctor blade according to claim 1 wherein the depth of the grooves (9) is approximately half of the thickness of the doctor blade.

6. Doctor blade according to claim 1 wherein the apex of the V at which the grooves merge into each other is positioned immediately ahead of the clamping zone (4) with respect to a direction transversely of the doctor blade.

7. Doctor blade according to claim 1 wherein the grooves of a V shaped formation include therebetween an acute angle.

* * * * *